US008779750B2

(12) United States Patent
Ozasa et al.

(10) Patent No.: US 8,779,750 B2
(45) Date of Patent: Jul. 15, 2014

(54) REFERENCE VOLTAGE GENERATING CIRCUIT AND REFERENCE VOLTAGE SOURCE

(71) Applicant: Panasonic Corporation, Osaka (JP)

(72) Inventors: Masayuki Ozasa, Kyoto (JP); Fumihito Inakai, Kyoto (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/779,167

(22) Filed: Feb. 27, 2013

(65) Prior Publication Data

US 2013/0241526 A1 Sep. 19, 2013

Related U.S. Application Data

(63) Continuation of application No. PCT/JP2012/001636, filed on Mar. 9, 2012.

(30) Foreign Application Priority Data

May 20, 2011 (JP) ..... 2011-113871

(51) Int. Cl.
*G05F 3/22* (2006.01)

(52) U.S. Cl.
USPC ..... 323/313

(58) Field of Classification Search
CPC ..... G05F 3/30; G05F 3/225; G05F 3/267; G05F 3/22; G05F 3/222; G05F 3/26
USPC ..... 323/312–317; 327/538–543
See application file for complete search history.

(56) References Cited

U.S. PATENT DOCUMENTS

| | | | | |
|---|---|---|---|---|
| 4,443,753 | A | 4/1984 | McGlinchey | |
| 5,424,628 | A | 6/1995 | Nguyen | |
| 6,255,807 | B1 * | 7/2001 | Doorenbos et al. | 323/314 |
| 7,193,454 | B1 * | 3/2007 | Marinca | 327/539 |
| 7,728,575 | B1 | 6/2010 | Ozalevli et al. | |
| 7,750,728 | B2 | 7/2010 | Marinca | |
| 7,880,459 | B2 * | 2/2011 | Harvey | 323/313 |

(Continued)

FOREIGN PATENT DOCUMENTS

| | | | |
|---|---|---|---|
| JP | 07-072945 | A | 3/1995 |
| JP | 2002-366238 | A | 12/2002 |
| JP | 2007-172153 | A | 7/2007 |

OTHER PUBLICATIONS

International Search Report issued in International Patent Application No. PCT/JP2012/001636 mailed on Jun. 12, 2012.

*Primary Examiner* — Matthew Nguyen
*Assistant Examiner* — Kyle J Moody
(74) *Attorney, Agent, or Firm* — McDermott Will & Emery LLP

(57) ABSTRACT

A reference voltage generating circuit includes: a reference voltage generating circuit element including a first diode characteristic element and a second diode characteristic element, a density of a current flowing through the second diode characteristic element being different from a density of a current flowing through the first diode characteristic element, the reference voltage generating circuit element being configured to output a reference voltage generated based on a difference between voltages respectively applied to the first diode characteristic element and the second diode characteristic element; a first adjusting circuit element configured to adjust a first-order temperature coefficient of the reference voltage; and a second adjusting circuit element configured to adjust a second-order temperature coefficient of the reference voltage.

5 Claims, 15 Drawing Sheets

(56) References Cited

U.S. PATENT DOCUMENTS

| | | | | |
|---|---|---|---|---|
| 8,004,917 | B2 * | 8/2011 | Pan et al. | 365/211 |
| 2006/0043957 | A1 | 3/2006 | Carvalho | |
| 2006/0290415 | A1 * | 12/2006 | Hazucha et al. | 327/539 |
| 2007/0052473 | A1 | 3/2007 | McLeod | |
| 2008/0074172 | A1 * | 3/2008 | Marinca | 327/539 |
| 2010/0007324 | A1 * | 1/2010 | Masson et al. | 323/313 |

* cited by examiner

REFERENCE VOLTAGE GENERATING CIRCUIT AND REFERENCE VOLTAGE SOURCE

RELATED APPLICATIONS

This is a continuation application under 35 U.S.C 111(a) of pending prior International application No. PCT/JP2012/001636, filed on Mar. 9, 2012, which in turn claims the benefit of Japanese Application No. 2011-113871, filed on May 20, 2011, the disclosures of which Applications are incorporated by reference herein.

BACKGROUND OF THE INVENTION

1. Field of the Invention

The present invention relates to a reference voltage generating circuit configured to generate a predetermined reference voltage and a reference voltage source including the reference voltage generating circuit, particularly to a reference voltage generating circuit and a reference voltage source each having an excellent temperature characteristic.

2. Description of the Related Art

Reference voltage generating circuits configured to stably supply a predetermined reference voltage at any temperature have been known. FIG. 14 is a circuit diagram showing a basic configuration of a conventional reference voltage generating circuit. As shown in FIG. 14, a reference voltage generating circuit 110 includes a first path P10, a second path P20, and a differential amplifier 40. On the first path P10, a first diode characteristic element Q10, such as a diode or a bipolar transistor, and a first resistor R10 are connected in series to each other. The first diode characteristic element Q10 has a diode characteristic (current-voltage characteristic by PN junction). On the second path P20, a second diode characteristic element Q20 and a second resistor R20 are connected in series to each other. The density of a current flowing through the second diode characteristic element Q20 is different from that of a current flowing through the first diode characteristic element Q10. To the differential amplifier 40, a voltage V10 obtained after the voltage drop by the first resistor R10 and a voltage V20 obtained after the voltage drop by the second resistor R20 are input. Further, on the second path P20, a third resistor R30 is connected in series to the second resistor R20. Then, a voltage (in the example shown in FIG. 14, an output voltage of the differential amplifier 40) applied to the first resistor R10 and the second resistor R20 is output as a reference voltage VBG. In the reference voltage generating circuit configured as above, the third resistor R30 (and the second resistor R20) is adjusted based on a difference between voltages, respectively applied to the diode characteristic elements Q10 and Q20 which are different in the density of the flowing current from each other, such that temperature dependence of the reference voltage VBG is eliminated (such that a differential dVBG/dT of the reference voltage VBG by a temperature T becomes zero).

It is known that a fluctuation range of the obtained reference voltage VBG by temperatures becomes narrow, but strictly, the obtained reference voltage VBG quadratically fluctuates by temperatures. FIG. 15 is a graph showing a temperature dependence characteristic of the reference voltage obtained by the conventional reference voltage generating circuit. FIG. 15 shows that the reference voltage has a quadratic temperature dependence characteristic in an assumed temperature range (−50 to 150° C.). This is because although a first-order temperature coefficient of the reference voltage is canceled by the reference voltage generating circuit shown in FIG. 14, a second-order temperature coefficient of the reference voltage still exists.

As a method of eliminating this quadratic temperature dependence characteristic, it has been thought in theory that a current which quadratically fluctuates by temperatures is caused to flow through a current path of the reference voltage generating circuit shown in FIG. 14. However, if the circuit is configured to generate the current which quadratically fluctuates in accordance with the quadratic temperature dependence characteristic, it becomes complex, and such circuit is not realistic.

Here, to eliminate the temperature dependence characteristic, for example, a configuration has been proposed, in which a plurality of correction current generating circuits are provided, and correction currents respectively generated by the correction current generating circuits are respectively used in a plurality of temperature ranges (see PTL 1 for example). In addition, another configuration has been proposed, in which a PTAT current which linearly changes with respect to an absolute temperature is generated, and temperature compensation is performed by performing adjustments such that a difference between the PTAT current and a CTAT current proportional to a voltage applied to the diode characteristic element by using the PTAT current and a resistor becomes zero (see PTL 2 for example).

CITATION LIST

Patent Literature

PTL 1: U.S. Pat. No. 7,728,575
PTL 2: U.S. Pat. No. 7,750,728

SUMMARY OF INVENTION

However, in a case where a plurality of correction current generating circuits are provided as in PTL 1, the problem is that the circuit configuration becomes complex. In addition, to improve the temperature dependence characteristic, adjustments corresponding to not the temperature range but the actual temperature are required. In addition, in a case where the difference between the PTAT current and the CTAT current is adjusted as in PTL 2, the circuit configuration becomes complex. Further, in each of PTLs 1 and 2, the temperature compensations are originally, collectively performed by adjusting a resistance value for correcting the first-order temperature coefficient. Therefore, there is a limit on the improvement of the temperature dependence characteristic.

The present invention was made to solve the above conventional problems, and an object of the present invention is to provide a reference voltage generating circuit capable of improving the temperature dependence characteristic by a simple configuration.

A reference voltage generating circuit according to one aspect of the present invention includes: a reference voltage generating circuit element including a first diode characteristic element and a second diode characteristic element, a density of a current flowing through the second diode characteristic element being different from a density of a current flowing through the first diode characteristic element, the reference voltage generating circuit element being configured to output a reference voltage generated based on a difference between voltages respectively applied to the first diode characteristic element and the second diode characteristic element; a first adjusting circuit element configured to adjust a first-order temperature coefficient of the reference voltage;

and a second adjusting circuit element configured to adjust a second-order temperature coefficient of the reference voltage.

According to the above configuration, the first-order temperature coefficient of the reference voltage generated by the reference voltage generating circuit element is adjusted by the first adjusting circuit element, and the second-order temperature coefficient of the reference voltage is adjusted by the second adjusting circuit element. As above, since the first-order temperature coefficient and the second-order temperature coefficient are respectively adjusted by the separate adjusting circuit elements, the temperature dependence characteristic can be improved by a simple configuration.

The second adjusting circuit element may include a current source configured to generate a current adjusted such that a second-order differential component of the reference voltage is canceled. According to this, since the second-order differential component of the reference voltage is canceled by the adjusted current, the temperature dependence characteristic can be easily improved.

Further, the current source may include a first circuit element having such a diode characteristic that the current generated by the current source cancels the second-order differential component of the reference voltage. According to this, a current based on the first circuit element having the diode characteristic is represented by a formula including an exponential function, and the second-order differential component of this current can be represented by using this current itself. Therefore, it is possible to easily generate a current by which the second-order differential component of a voltage obtained by subtracting a voltage based on the above current based on the first circuit element from the reference voltage becomes zero. On this account, the current which cancels the second-order differential component of the reference voltage can be easily generated by a simple configuration.

Further, the first circuit element may include a bipolar transistor, the current source may include the first circuit element, a second circuit element, and a current mirror circuit element, the second circuit element being configured to cause a current to flow between a collector and emitter of the first circuit element based on a current flowing through one of the first and second diode elements of the reference voltage generating circuit element, the current mirror circuit element being configured to receive a current flowing through a base of the first circuit element and output a correction current to a path of the reference voltage generating circuit element, and the current mirror circuit element may be configured such that a current input to the reference voltage generating circuit element is adjusted by adjusting an input-output ratio of the current mirror circuit element. According to this, the current based on the first circuit element becomes a base current of the bipolar transistor. Since the base current of the bipolar transistor has the diode characteristic, it is represented by a formula including an exponential function. Then, the magnitude of the correction current flowing into or flowing out from the path of the reference voltage generating circuit element is adjusted by adjusting the input-output ratio of the current mirror circuit element. Therefore, by adjusting the input-output ratio of the current mirror circuit element, a current which adjusts the second-order temperature coefficient can be easily generated based on the correction current. Moreover, by using the second circuit element as the current source of the first circuit element, the adjust current can be generated from the current utilized in the reference voltage generating circuit element. Therefore, the adjust current which adjusts the second-order temperature coefficient of the reference voltage can be easily generated by a simple configuration without providing an additional current source.

Moreover, the reference voltage generating circuit element may include a first path including the first diode characteristic element and a first resistor connected in series to the first diode characteristic element, a second path including the second diode characteristic element and a second resistor connected in series to the second diode characteristic element, and a differential amplifier configured to receive a first voltage at a predetermined portion of the first path and a second voltage at a portion of the second path corresponding to the first voltage, and is configured to output as the reference voltage a voltage applied to at least one of the first resistor and the second resistor, and the first adjusting circuit element may include an adjusting resistor connected to one of the first diode characteristic element and the second diode characteristic element.

A reference voltage source according to another aspect of the present invention includes: the reference voltage generating circuit configured as above; and an amplifier configured to amplify the reference voltage. Since to the reference voltage source configured as above outputs the reference voltage in which the first-order temperature coefficient and the second-order temperature coefficient are respectively adjusted by the separate adjusting circuit elements, the temperature dependence characteristic can be improved by a simple configuration.

The present invention is configured as explained above and has an effect of improving the temperature dependence characteristic by a simple configuration.

The above object, other objects, features and advantages of the present invention will be made clear by the following detailed explanation of preferred embodiments with reference to the attached drawings.

DESCRIPTION OF THE PREFERRED EMBODIMENTS

Figure 1:
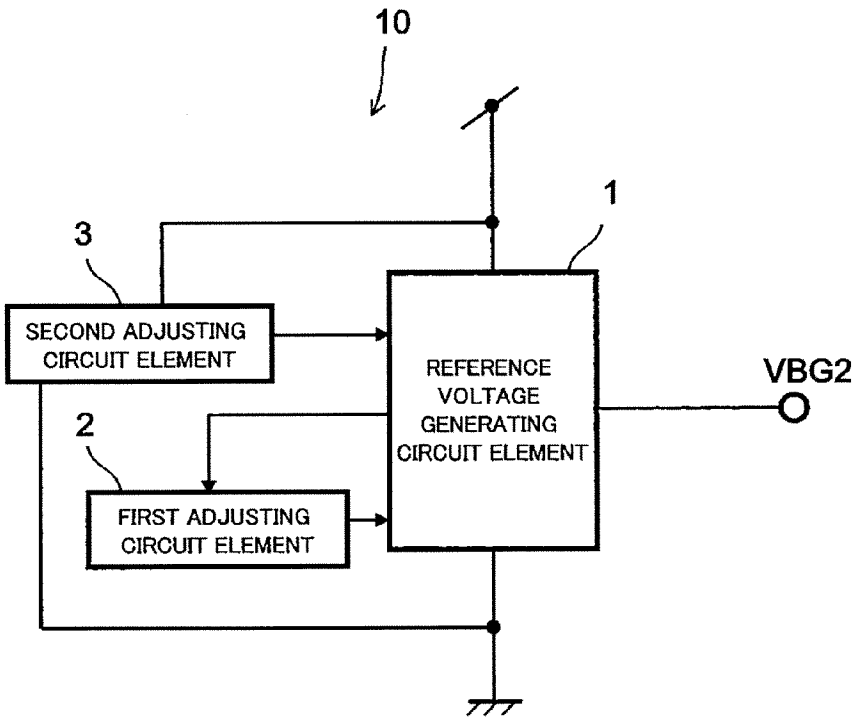
FIG. 1 is a circuit diagram showing a schematic configuration example of a reference voltage generating circuit according to Embodiment 1 of the present invention.

Hereinafter, embodiments of the present invention will be explained in reference to the drawings. In the drawings, the same reference signs are used for the same or corresponding components, and a repetition of the same explanation is avoided.

Embodiment 1

First, a reference voltage generating circuit according to Embodiment 1 of the present invention will be explained. FIG. 1 is a circuit diagram showing a schematic configuration example of the reference voltage generating circuit according to Embodiment 1 of the present invention.

As shown in FIG. 1, a reference voltage generating circuit 10 according to the present embodiment includes a reference voltage generating circuit element 1, a first adjusting circuit element 2, and a second adjusting circuit element 3. The reference voltage generating circuit element 1 includes a first diode characteristic element (described later) and a second diode characteristic element (described later) and outputs a reference voltage VBG1 generated based on the difference between voltages respectively applied to the first diode characteristic element and the second diode characteristic element. The density of a current flowing through the second diode characteristic element is different from that of a current flowing through the first diode characteristic element. The first adjusting circuit element 2 adjusts a first-order temperature coefficient of the reference voltage VBG1, and the second adjusting circuit element 3 adjusts a second-order temperature coefficient of the reference voltage VBG1.

According to the above configuration, the first-order temperature coefficient of the reference voltage VBG1 generated by the reference voltage generating circuit element 1 is adjusted by the first adjusting circuit element 2, and the second-order temperature coefficient of the reference voltage VBG1 is adjusted by the second adjusting circuit element 3. As above, since the first-order temperature coefficient and the second-order temperature coefficient are respectively adjusted by the separate adjusting circuit elements 2 and 3, the temperature dependence characteristic can be improved by a simple configuration.

Figure 2:
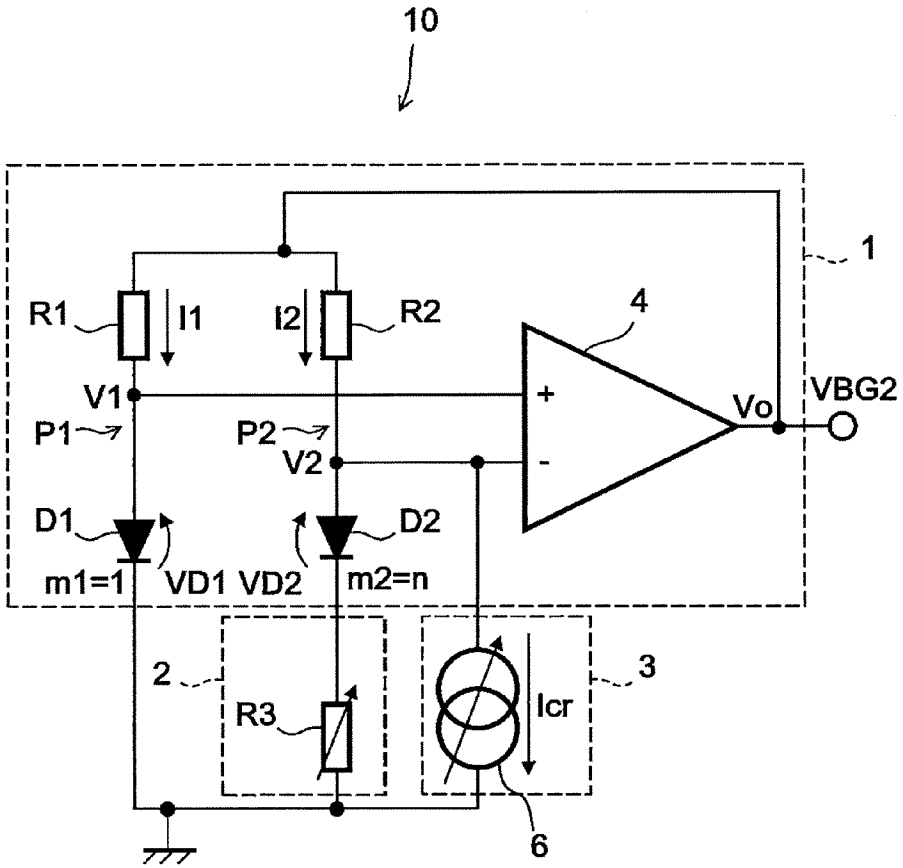
FIG. 2 is a circuit diagram showing a specific configuration example of the reference voltage generating circuit shown in FIG. 1.

Hereinafter, specific explanations will be made. FIG. 2 is a circuit diagram showing a specific configuration example of the reference voltage generating circuit shown in FIG. 1. As shown in FIG. 2, in the reference voltage generating circuit of the present embodiment, the reference voltage generating circuit element 1 includes a first path P1 and a second path P2. The first path P1 includes a first diode characteristic element D1 and a first resistor R1 connected in series to the first diode characteristic element D1, and the second path P2 includes a second diode characteristic element D2 and a second resistor R2 connected in series to the second diode characteristic element D2. Here, a current density (element size) m2 of the second diode characteristic element D2 is n times a current density m1 of the first diode characteristic element D1 (m1=1, m2=n).

Further, the reference voltage generating circuit element 1 includes a differential amplifier 4 to which a first voltage V1 at a predetermined portion of the first path P1 and a second voltage V2 at a portion, corresponding to the first voltage V1, of the second path P2 are input. In the present embodiment, the first voltage V1 is a voltage obtained by causing a reference voltage VBG2 to drop by the first resistor R1 on the first path P1, the reference voltage VBG2 being an output voltage V0 of the differential amplifier 4, and the second voltage V2 is a voltage obtained by causing the reference voltage VBG2 to drop by the second resistor R2 on the second path P2, the reference voltage VBG2 being the output voltage Vo of the differential amplifier 4. The first voltage V1 is applied to a noninverting input terminal of the differential amplifier 4, and the second voltage V2 is applied to an inverting input terminal of the differential amplifier 4. Then, the reference voltage generating circuit element 1 is configured to output as the reference voltage VBG2 the voltage applied to at least one of (in FIG. 2, each of) the first resistor R1 and the second resistor R2.

The first adjusting circuit element 2 includes an adjusting resistor R3 connected to one of the first diode characteristic element D1 and the second diode characteristic element D2. The second adjusting circuit element 3 includes a current source 6 configured to generate an adjust current Icr adjusted such that a second-order differential component of the reference voltage VBG2 is canceled. In the present embodiment, the current source 6 is connected to the inverting input terminal of the differential amplifier 4.

Here, a principle of the present invention will be explained. First, the following will explain that the first-order temperature coefficient of the reference voltage VBG2 is adjusted by providing the first adjusting circuit element 2.

In a case where a current flowing through the first path P1 is denoted by I1, a current flowing through the second path P2 is denoted by I2, and saturation currents of the first and second diode characteristic elements D1 and D2 are respectively denoted by IS1 and IS2, diode characteristic voltages VD1 and VD2 respectively applied to the first and second diode characteristic elements D1 and D2 are represented as below using a thermal voltage $V_T$.

Formula 1

$$VD1 = V_T \ln\left(\frac{I1}{IS1}\right) \qquad (1)$$

$$VD2 = V_T \ln\left(\frac{I2}{IS2}\right)$$

Here, the thermal voltage $V_T$ is represented by a formula "$V_T = k_B T/q$". In this formula, $k_B$ denotes a Boltzmann constant, T denotes a temperature, and q denotes a quantum of electricity. In addition, since a current density ratio (size ratio) between the first and second diode characteristic elements D1 and D2 is n, a formula "IS2=nIS1" is obtained.

By using the diode characteristic voltages VD1 and VD2, the first voltage V1 and the second voltage V2 can be respectively represented by formulas "V1=VD1" and "V2=VD2+I2·R3". Here, since a portion between the input terminals of the differential amplifier 4 is virtually grounded, the first voltage V1 and the second voltage V2 are equal to each other. Therefore, a formula "VD1=VD2+I2·R3" is obtained. Based on this formula, Formula 2 below is obtained.

Formula 2

$$\begin{aligned} I2 &= \frac{VD1 - VD2}{R3} \\ &= \frac{V_T}{R3}\cdot\left(\ln\left(\frac{I1}{IS1}\right) - \ln\left(\frac{I2}{IS2}\right)\right) \\ &= \frac{V_T}{R3}\ln\left(\frac{I1}{I2}\cdot\frac{IS2}{IS1}\right) = \frac{V_T}{R3}\ln\left(\frac{I1}{I2}\cdot n\right) \end{aligned} \tag{2}$$

In the present embodiment, resistance values of the first resistor R1 and the second resistor R2 are equal to each other. Therefore, since the first voltage V1 and the second voltage V2 are equal to each other, the first current I1 and the second current I2 are also equal to each other. Therefore, Formula 2 can be represented as below.

Formula 3

$$I2 = \frac{V_T}{R3}\ln(n) \tag{3}$$

By using the current I2, the reference voltage VBG2 is represented by a formula "VBG2=VD2+I2·(R2+R3)". By substituting Formula 3 in this formula, Formula 4 below is obtained.

Formula 4

$$VBG2 = VD2 + V_T\ln(n)\cdot\frac{R_2 + R_3}{R_3} \tag{4}$$

To set the first-order temperature coefficient of the reference voltage VBG2 to zero, a first order differential component regarding the temperature T in Formula 4 may be set to zero. Therefore, Formula 5 below is obtained by performing first-order differentiation of Formula 4 by the temperature T.

Formula 5

$$\begin{aligned} \frac{dVBG2}{dT} &= \frac{dVD2}{dT} + \frac{dV_T}{dT}\cdot\ln(n)\cdot\frac{R_2 + R_3}{R_3} \\ &= \frac{dVD2}{dT} + \frac{k_B}{q}\cdot\ln(n)\cdot\frac{R_2 + R_3}{R_3} \end{aligned} \tag{5}$$

By adjusting the adjusting resistor R3 of the first adjusting circuit element 2 such that Formula 5 becomes zero, the first-order temperature coefficient of the reference voltage VBG2 can be set to zero. For example, in a case where n is set to 8, and R2 is set to 90 kΩ, and a known temperature characteristic dVD2/dT of the second diode characteristic element D2 is set to −1.8 mV/° C., a resistance value R3 of the adjusting resistor R3 becomes 10 kΩ. This calculation is performed on the basis that $k_B/q$ is 86.17 μV. By using the voltage VD1 of the first diode characteristic element D1, the reference voltage VBG2 is represented by a formula "VBG2=VD1+I1·R1" (I1=I2, R1=R2). Therefore, based on this formula, the reference voltage VBG2 at room temperature (300K) becomes 1.186 V. This calculation is performed on the basis that the voltage of the first diode characteristic element D1 at the room temperature is 0.7 V. As above, the first-order temperature coefficient of the reference voltage VBG2 can be adjusted by adjusting the resistance value of the adjusting resistor R3 of the first adjusting circuit element 2.

Next, the following will explain that the second-order temperature coefficient of the reference voltage VBG2 is adjusted by providing the second adjusting circuit element 3.

A band gap voltage VBG(T) for generating the reference voltage VBG2 can be expanded in a series regarding the temperature T as below.

Formula 6

$$VBG(T) = a0 + a1\cdot\left(\frac{\Delta T}{T_0}\right) + a2\cdot\left(\frac{\Delta T}{T_0}\right)^2 + a3\cdot\left(\frac{\Delta T}{T_0}\right)^3 + \ldots \tag{6}$$

In Formula 6, ai (i=0, 1, 2, . . . ) denotes a constant, $T_0$ denotes a reference temperature, ΔT denotes a temperature difference between the temperature T and a predetermined reference temperature $T_0$.

In Formula 6, in a case where the second-order differentiation of the band gap voltage VBG(T) is performed as a function of "$t=\Delta T/T_0$", the band gap voltage VBG(T) can be approximated as below.

Formula 7

$$\frac{d^2 VBG(t)}{dt^2} = 2\cdot a2 \tag{7}$$

Here, since a third-order term and subsequent terms become ignorable values in an assumed temperature range, they are ignored (2·a2>>6t·a3).

In the present embodiment, the reference voltage generating circuit outputs the reference voltage VBG2(*t*) in which the second-order temperature coefficient is canceled by adding the adjust current Icr(t) to the band gap voltage VBG(T). That is, the reference voltage VBG2(*t*) becomes a voltage obtained by adding to the band gap voltage VBG(T) a voltage obtained by causing the adjust current Icr to flow through the second resistor R2. To be specific, the reference voltage VBG2(*t*) is represented by a formula "VBG2(*t*)=VBG(t)−R2·Icr(t)".

Formula 8 below is obtained by performing the second-order differentiation of the reference voltage VBG2(*t*) represented as above.

Formula 8

$$\frac{d^2 VBG2(t)}{dt^2} = 2\cdot a2 - R2\cdot\frac{d^2 Icr(t)}{dt^2} \tag{8}$$

Therefore, by adjusting the adjust current Icr output from the current source 6 of the second adjusting circuit element 3 such that Formula 8 becomes zero when t is zero, that is, when the temperature T is the reference temperature $T_0$ (for example, 27° C.=300K), the second-order temperature coefficient of the reference voltage VBG2 can be set to zero.

Here, to cancel the second-order differential component 2·a2 of the reference voltage VBG2, for example, a current which changes exponentially may be adopted as the adjust current Icr. In this case, by using a constant C, the adjust current Icr is represented by a formula "Icr(t)=C·exp(−t)". At this time, by substituting the Icr(t) in Formula 8, Formula 9 below is obtained.

Formula 9

$$\begin{aligned}\frac{d^2 VBG2(t)}{dt^2} &= 2\cdot a2 - R2\cdot C\cdot \frac{d^2}{dt^2}\exp(-t) \\ &= 2\cdot a2 - R2\cdot C\cdot \exp(-t) \\ &= 2\cdot a2 - R2\cdot C\cdot Icr(t)\end{aligned} \tag{9}$$

The adjust current Icr by which $d^2/dt^2$(VBG2(0)) becomes zero is obtained as below based on Formula 9.

Formula 10

$$\begin{aligned}&2\cdot a2 - R2\cdot C\cdot Icr(0) = 0 \\ &\rightarrow Icr(t) = \frac{2\cdot a2}{R2\cdot C}\end{aligned} \tag{10}$$

As above, by adjusting the reference voltage VBG2 by the current Icr adjusted such that the second-order differential component of the reference voltage VBG2 is canceled, the second-order temperature coefficient of the reference voltage VBG2 is canceled by the adjust current. Therefore, the temperature dependence characteristic can be easily improved. Instead of the adjust current Icr represented by the formula "Icr(t)=C·exp(−t)", for example, a current represented by "Icr (t)=C/t (where C denotes a constant) may be adopted.

Embodiment 2

Figure 3:
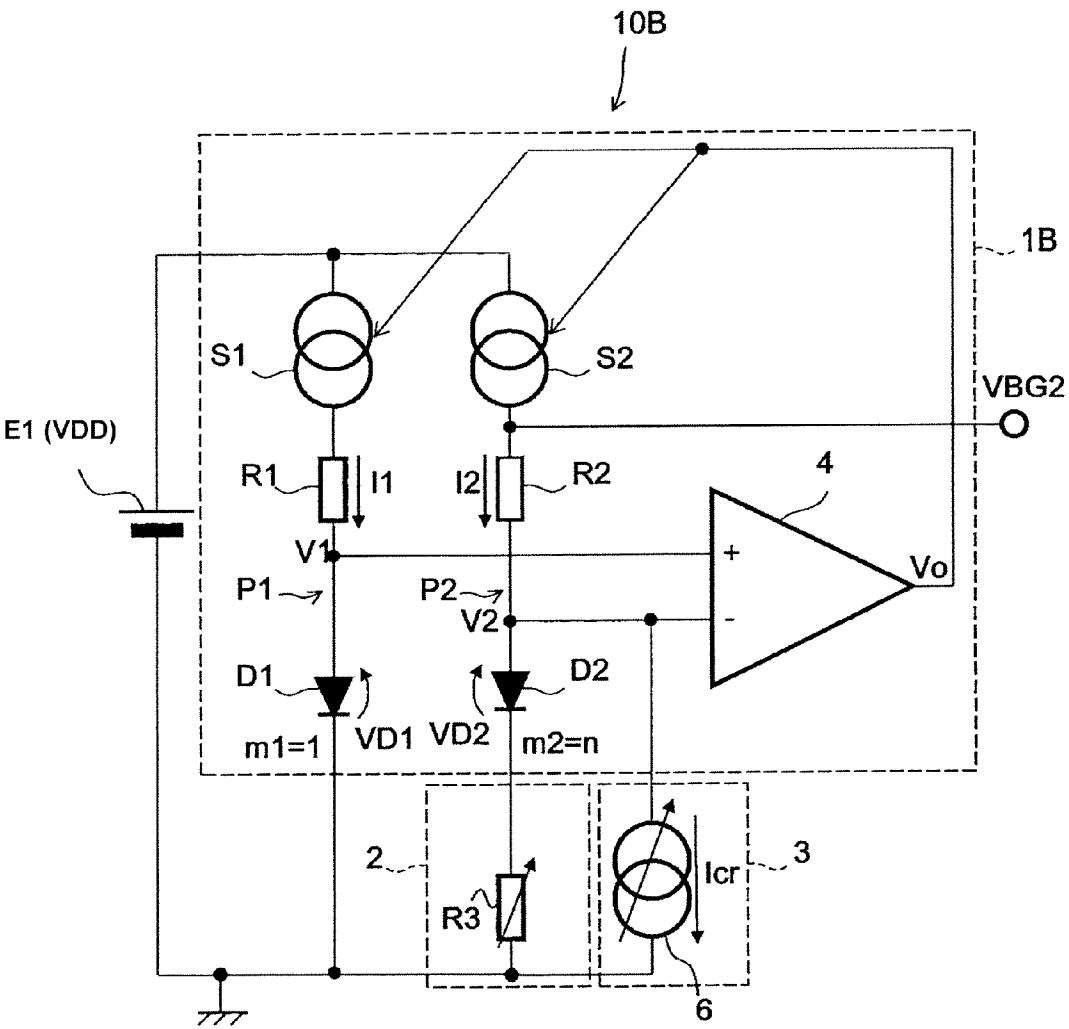
FIG. 3 is a circuit diagram showing a schematic configuration example of the reference voltage generating circuit according to Embodiment 2 of the present invention.

Next, the reference voltage generating circuit according to Embodiment 2 of the present invention will be explained. FIG. 3 is a circuit diagram showing a schematic configuration example of the reference voltage generating circuit according to Embodiment 2 of the present invention. In the present embodiment, the same reference signs are used for the same components as in Embodiment 1, and a repetition of the same explanation is avoided. A reference voltage generating circuit 10B of the present embodiment is different from the reference voltage generating circuit 10 of Embodiment 1 in that a reference voltage generating circuit element 1B includes a first current source element S1 and a second current source element S2. The first current source element S1 adjusts based on the output of the differential amplifier 4 a current flowing through the first path P1, and the second current source element S2 adjusts based on the output of the differential amplifier 4 a current flowing through the second path P2. The first current source element S1 and the second current source element S2 are connected in parallel to each other and connected in series to a power supply E1 configured to output a power supply voltage VDD. In the present embodiment, the reference voltage VBG2 is output as a voltage between the second current source element S2 and the second resistor R2.

Even in the above configuration, as with Embodiment 1, the first-order temperature coefficient of the reference voltage VBG2 is adjusted by adjusting the resistance value of the adjusting resistor R3, and the second-order temperature coefficient of the reference voltage VBG2 is adjusted by adjusting the adjust current Icr of the current source 6.

Figure 4:
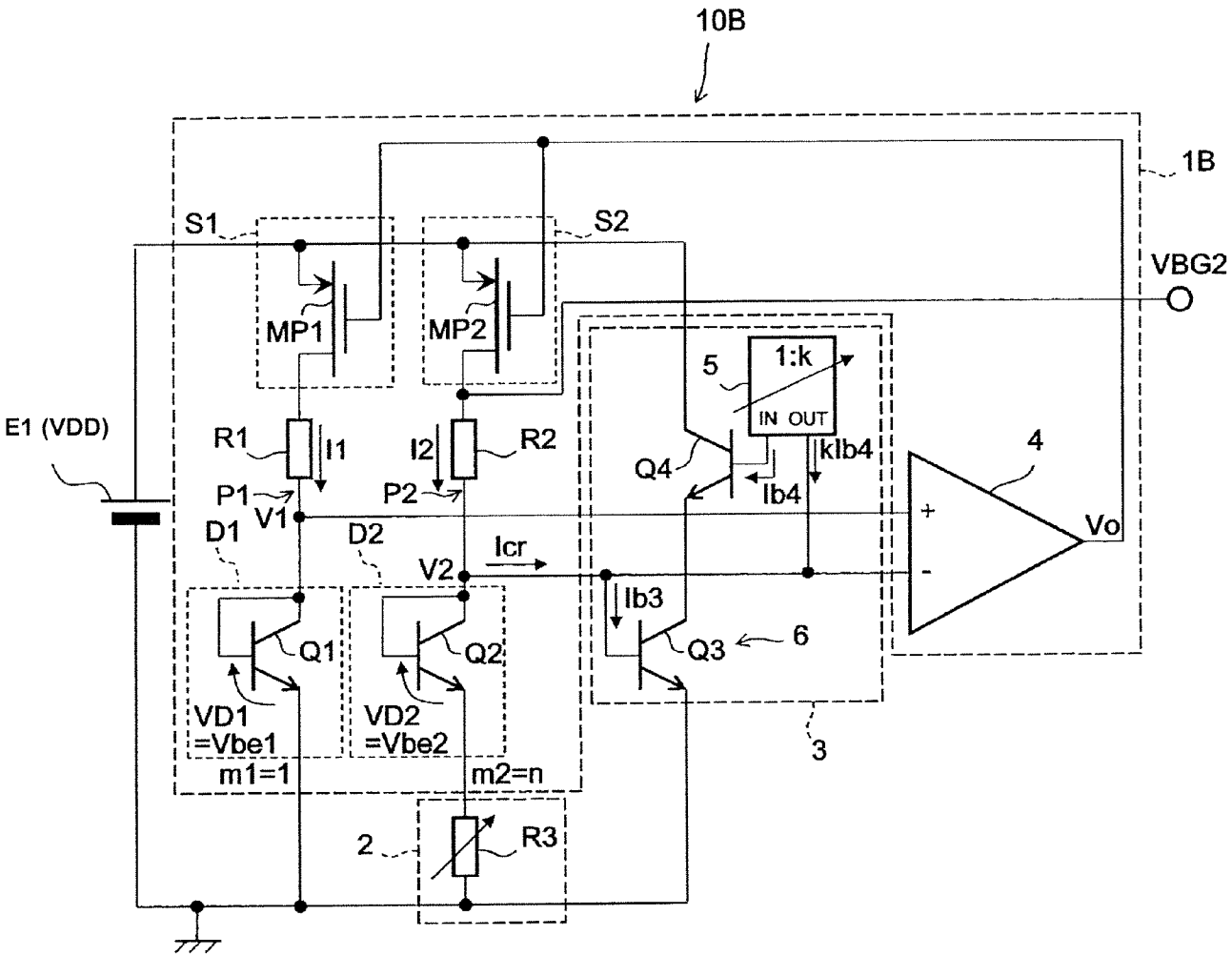
FIG. 4 is a circuit diagram showing a more specific configuration example of the reference voltage generating circuit shown in FIG. 3.

Here, a more specific circuit configuration in the configuration of the present embodiment will be explained. FIG. 4 is a circuit diagram showing a more specific configuration example of the reference voltage generating circuit shown in FIG. 3. As shown in FIG. 4, the first diode characteristic element D1 includes a first bipolar transistor (npn transistor in the present embodiment) Q1, and the second diode characteristic element D2 includes a second bipolar transistor (npn transistor in the present embodiment) Q2. The first bipolar transistor Q1 is diode-connected between the first resistor R1 and ground (short-circuit between a base and a collector). Similarly, the second bipolar transistor Q2 is diode-connected between the second resistor R2 and the ground. Therefore, the voltage VD1 of the first diode characteristic element D1 is equal to a base-emitter voltage Vbe1 of the first bipolar transistor Q1, and the voltage VD2 of the second diode characteristic element D2 is equal to a base-emitter voltage Vbe2 of the second bipolar transistor Q2.

The first current source element S1 includes a P-channel MOS transistor MP1, and the second current source element S2 includes a P-channel MOS transistor MP2. The power supply E1 is connected to one of main terminals of the P-channel MOS transistor MP1, the first resistor R1 is connected to the other main terminal of the P-channel MOS transistor MP1, and an output terminal of the differential amplifier 4 is connected to a control terminal of the P-channel MOS transistor MP1. Similarly, the power supply E1 is connected to one of main terminals of the P-channel MOS transistor MP2, the second resistor R2 is connected to the other main terminal of the P-channel MOS transistor MP2, and the output terminal of the differential amplifier 4 is connected to a control terminal of the P-channel MOS transistor MP2.

Figure 5:
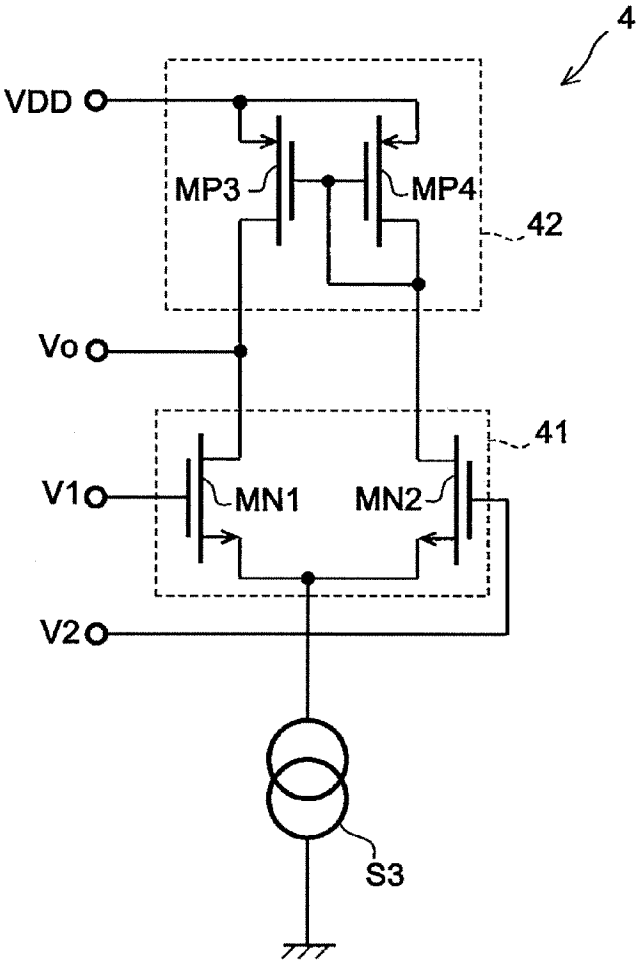
FIG. 5 is a circuit diagram showing a configuration example of a differential amplifier in the reference voltage generating circuit shown in FIG. 2.

FIG. 5 is a circuit diagram showing a configuration example of the differential amplifier in the reference voltage generating circuit shown in FIG. 2. As shown in FIG. 5, the differential amplifier 4 in the present embodiment is constituted by a plurality of MOS transistors. Specifically, the differential amplifier 4 includes a constant current source S3, a MOS transistor differential pair 41, and a MOS transistor current mirror pair 42. The MOS transistor differential pair 41 includes two N-channel MOS transistors MN1 and MN2. The first voltage V1 is applied to a gate of the N-channel MOS transistor MN1, and the second voltage V2 is applied to a gate of the N-channel MOS transistor MN2. By applying the power supply voltage VDD to the MOS transistor current mirror pair 42, a pair of mirror currents equal to each other flow through the MOS transistor current mirror pair 42. The MOS transistor current mirror pair 42 includes two P-channel MOS transistors MP3 and MP4.

The N-channel MOS transistor MN1 to which the first voltage V1 is applied serves as the noninverting input terminal of the differential amplifier 4, and the N-channel MOS transistor MN2 to which the second voltage V2 is applied serves as the inverting input terminal of the differential amplifier 4. The differential amplifier 4 is configured to output through the output terminal (output voltage Vo) thereof a voltage between a source of the P-channel MOS transistor MP3 by which a current flows through the N-channel MOS transistor MN1 and a drain of the N-channel MOS transistor MN1. With this, the current generated in the MOS transistor differential pair 41 by the difference between the first voltage V1 and the second voltage V2 is output through the output terminal, and a voltage corresponding to this output current is generated as the output voltage Vo.

Figure 6B:
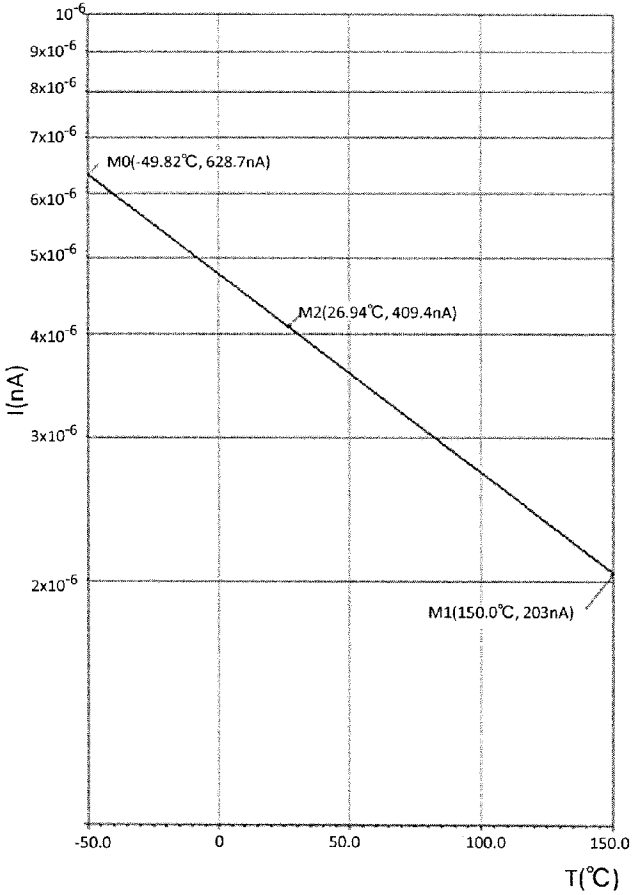
FIGS. 6A and 6B are graphs each showing a change characteristic of a base current of an npn transistor with respect to temperatures.
Figure 6A:
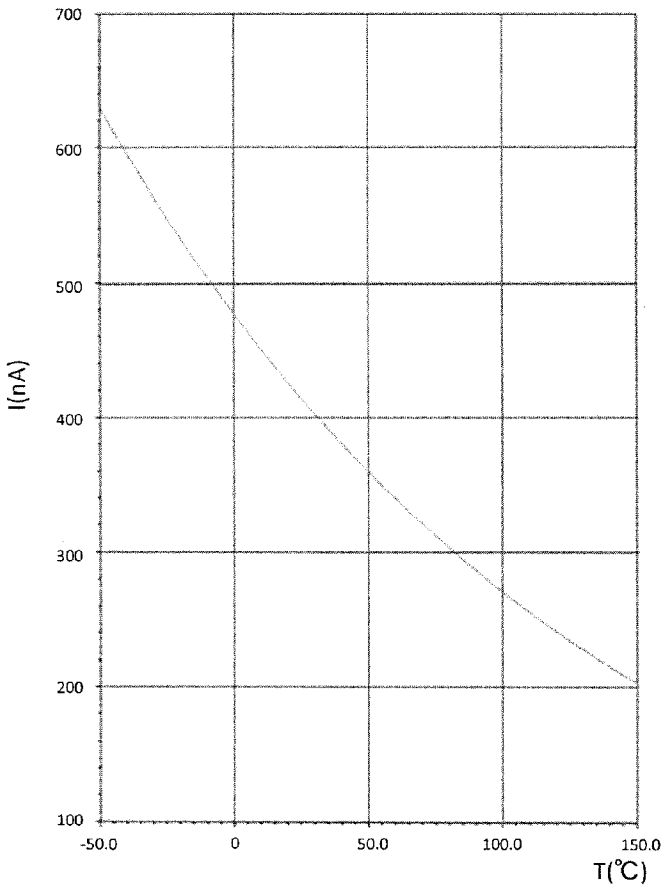

As shown in FIG. 4, the second adjusting circuit element 3 includes as the current source 6 a first circuit element having such a diode characteristic that the current generated by the first circuit element can cancel the second-order differential component of the reference voltage VBG2. In the present embodiment, the first circuit element includes a bipolar transistor Q4 (npn transistor in the present embodiment). Therefore, a base current IB4 of the bipolar transistor Q4 has the diode characteristic. FIGS. 6A and 6B are graphs each showing a change characteristic of the base current of the npn transistor with respect to temperatures. FIG. 6A is a linear graph, and FIG. 6B is a semilog graph. In the semilog graph shown in FIG. 6B, the current linearly changes with respect to the temperature of the npn transistor. Therefore, it is understood that the base current of the npn transistor changes exponentially with respect to the temperature change.

As above, the adjust current Icr(t) based on the first circuit element (bipolar transistor Q4) having the diode characteristic becomes a current represented by a formula including an exponential function exp(t). Therefore, as described above, the second-order differential component of the adjust current Icr(t) can be represented by using the current Icr(t) itself. Therefore, it is possible to easily generate a current by which the second-order differential component of a voltage obtained by subtracting a voltage R2·Icr(t) from the reference voltage VBG2(*t*) becomes zero, the voltage R2·Icr(t) being based on the adjust current Icr (t). On this account, the adjust current Icr(t) which cancels the second-order differential component of the reference voltage VBG2 can be generated easily by a simple configuration.

The second adjusting circuit element 3 will be explained more specifically. As shown in FIG. 4, the second adjusting circuit element 3 includes the above-described first circuit element (bipolar transistor) Q4 as the current source 6, a second circuit element, and a current mirror circuit element 5. The second circuit element causes a current to flow between the collector and emitter of the first circuit element Q4 based on the current flowing through one of the first and second diode elements of the reference voltage generating circuit element 1B (in FIG. 4, based on the second current I2 flowing through the second diode element D2). The current mirror circuit element 5 receives the current flowing through a base of the first circuit element Q4 and outputs a correction current to a path of the reference voltage generating circuit element 1B (in FIG. 4, to the inverting input terminal of the differential amplifier 4). The adjust current Icr flows through the inverting input terminal of the reference voltage generating circuit element 1B based on the second current I2. The reference voltage generating circuit element 1B causes a current to flow between the collector and emitter of the first circuit element Q4 based on the adjust current Icr.

In FIG. 4, for convenience sake, an arrow indicating the adjust current Icr is shown such that the adjust current Icr flows into the inverting input terminal of the differential amplifier 4. However, the flow direction of the adjust current Icr is not limited to this direction. The adjust current Icr may flow out from the inverting input terminal of the differential amplifier 4 (that is, flow into the second diode element D2).

The second circuit element includes a bipolar transistor Q3. A collector current flowing based on a base current IB3 of the bipolar transistor Q3 becomes an emitter current of the bipolar transistor Q4, and the base current IB4 of the bipolar transistor Q4 flowing based on the emitter current of the bipolar transistor Q4 becomes an input current of the current mirror circuit element 5. The second circuit element is not limited to this as long as it can supply the current to the first circuit element. For example, the second circuit element may be a MOS transistor.

The current mirror circuit element 5 is configured such that a correction current kIB4 supplied to the path of the reference voltage generating circuit element 1B is adjusted by adjusting an input-output ratio (1:k).

As above, the magnitude of the correction current kIB4 flowing into or flowing out from the path of the reference voltage generating circuit element 1B is adjusted by adjusting the value of k of the input-output ratio (1:k) of the current mirror circuit element 5. By using the base current IB3 of the bipolar transistor Q3 and the correction current kIB4, the adjust current Icr can be represented by a formula "Icr=−IB3+kIB4". As above, the adjust current Icr can be easily adjusted by adjusting the input-output ratio (1:k) of the current mirror circuit element 5.

Figure 7:
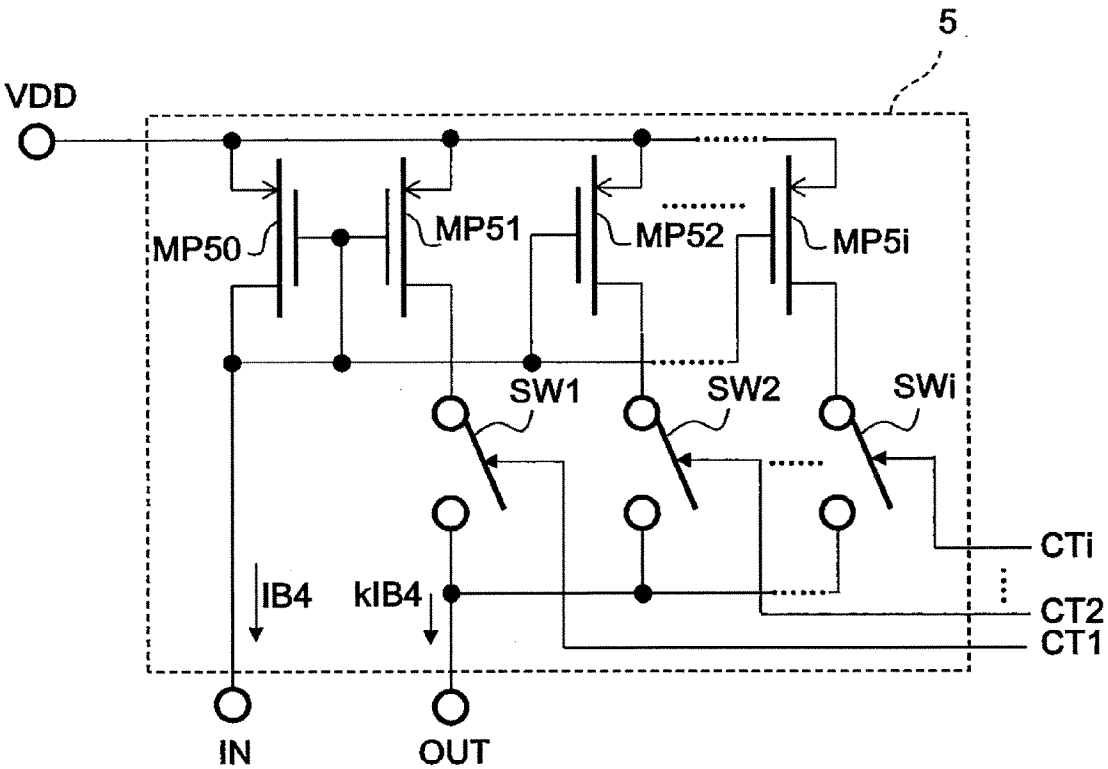
FIG. 7 is a circuit diagram showing a configuration example of a current mirror circuit element in the reference voltage generating circuit shown in FIG. 4.

FIG. 7 is a circuit diagram showing a configuration example of the current mirror circuit element in the reference voltage generating circuit shown in FIG. 4. As shown in FIG. 7, the current mirror circuit element 5 of the present embodiment includes a plurality of P-channel MOS transistors MP50 and MP5*i* (i=1, 2, . . . ) and a plurality of switches SWi (i=1, 2, . . . ). One of the plurality of P-channel MOS transistors is an input-side MOS transistor MP50 through which the base current of the bipolar transistor Q4 flows as an input current. The other P-channel MOS transistors are output-side MOS transistors MP5*i* configured to generate an output current.

One of main terminals of the input-side MOS transistor MP50 is connected to the power supply E1, and the other main terminal and a control terminal of the input-side MOS transistor MP50 are connected to an input terminal IN (that is, the base of the bipolar transistor Q4). One of main terminals of each of the output-side MOS transistors MP5*i* is connected to the power supply E1, and the other main terminal thereof is connected through the corresponding switch SWi to an output terminal OUT (that is, the inverting input terminal of the differential amplifier 4). Each of the switches SWi is turned on or off by a switching signal input to a control terminal CTi in accordance with a control signal supplied from outside.

According to the above configuration, the switching signal is transferred to each of the control terminals CTi based on the calculation result of the adjust current Icr which cancels the second-order temperature coefficient of the reference voltage VBG2. With this, each of the switches SWi is turned on or off such that the input-output ratio (1:k) becomes a ratio by which the adjust current Icr is generated. When the switch SWi is turned on, a current flows between the main terminals of the corresponding output-side MOS transistor MP5*i*, and a current flowing through the switch SWi which has been turned on is added to the above current. Thus, the output current kIB4 is output through the output terminal.

Here, the currents flowing through the plurality of output-side MOS transistors MP5*i* when turned on may be different from one another. With this, in accordance with the switches SWi, a current can be caused to flow through the output-side MOS transistors MP5*i* which are different in weighting from one another (i-bit adjustment is realized). Therefore, the output current can be adjusted more finely.

As above, the base currents IB3 and IB4 are currents having the diode characteristic. Therefore, it is possible to easily perform such an adjustment that the second-order differential component of a voltage obtained by subtracting a voltage (R2·Icr) based on the adjust current Icr from the reference voltage VBG2 becomes zero. In addition, by using the second circuit element as the current source of the first circuit element, the adjust current Icr can be generated from the current utilized in the reference voltage generating circuit element 1B. Therefore, the adjust current Icr which adjusts the second-order temperature coefficient of the reference voltage VBG2 can be easily generated by a simple configuration without providing an additional current source.

Figure 8:
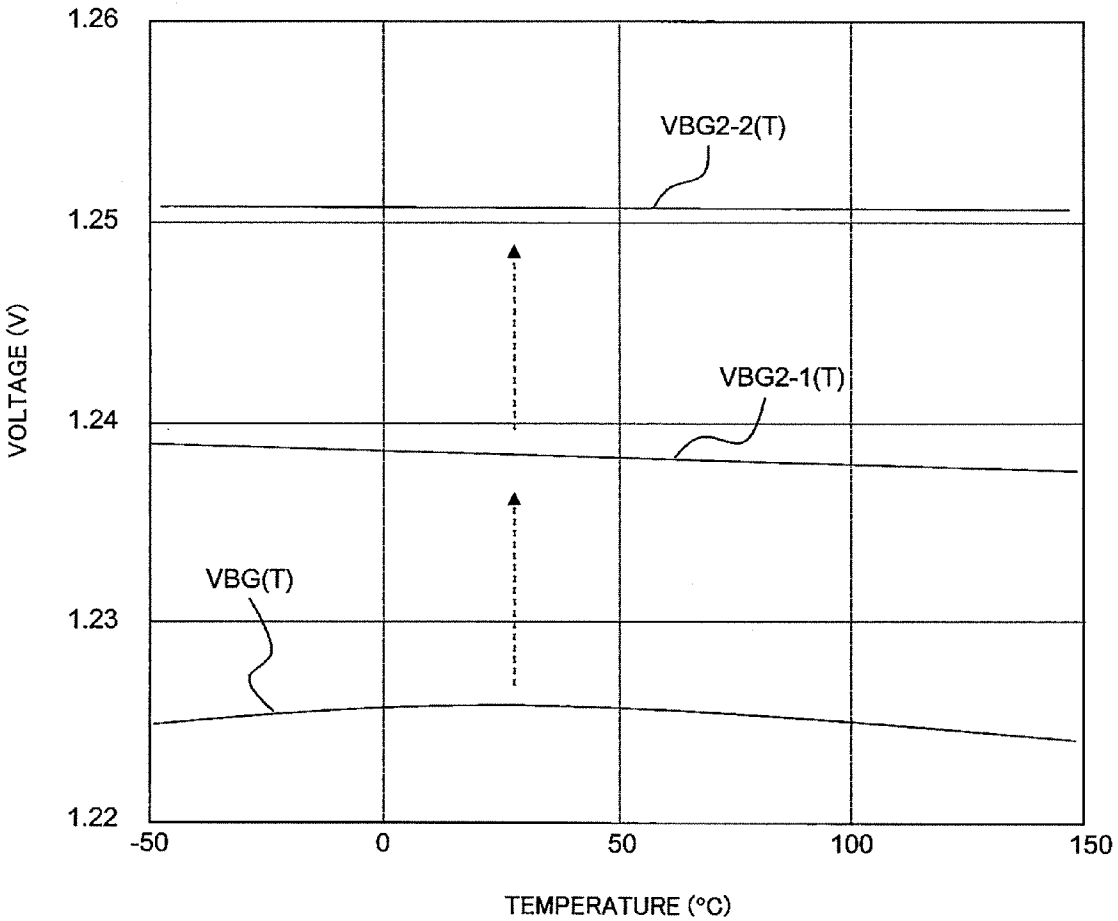
FIG. 8 is a graph showing a reference voltage output by the reference voltage generating circuit shown in FIG. 3.
Figure 9:
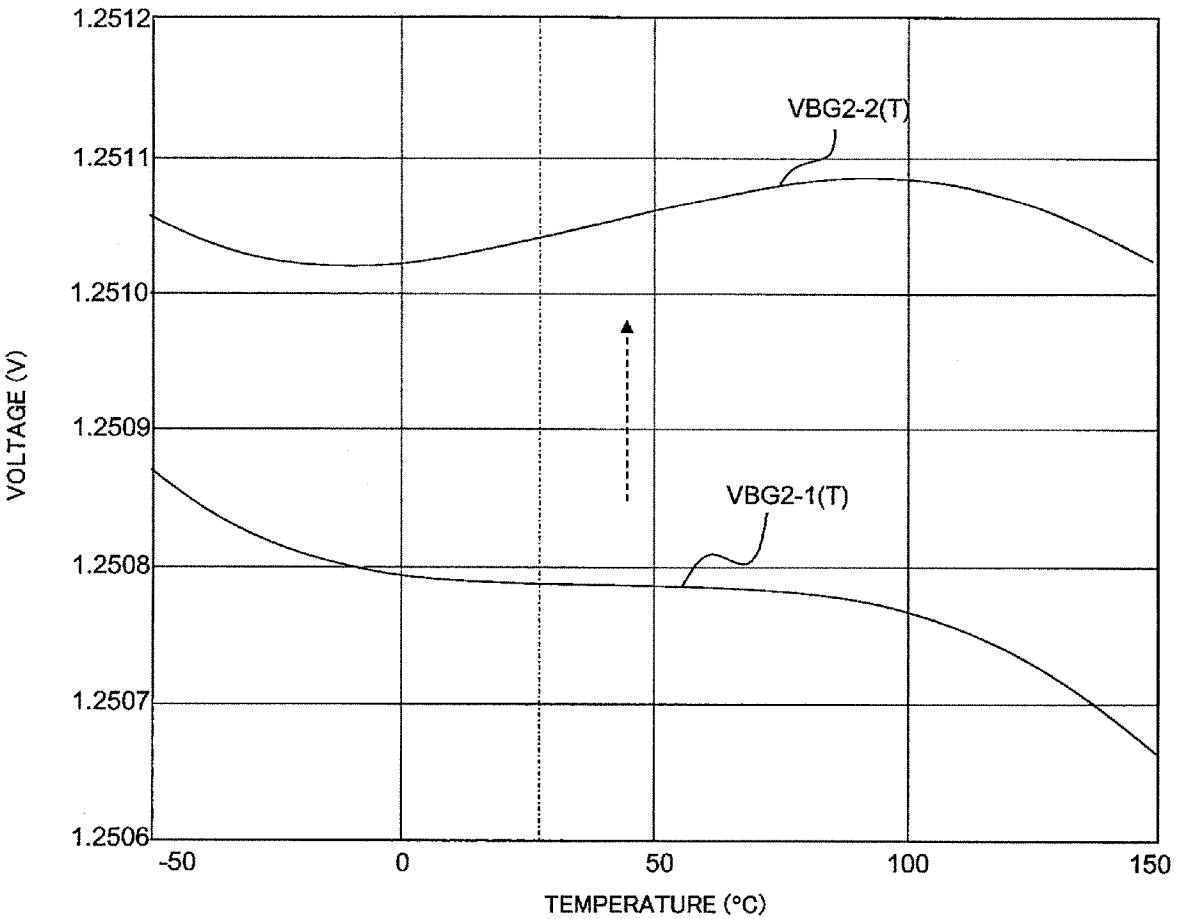
FIG. 9 is a graph showing the reference voltage output by the reference voltage generating circuit shown in FIG. 3.

FIGS. 8 and 9 are graphs each showing the reference voltage output from the reference voltage generating circuit shown in FIG. 3. FIG. 8 shows a reference voltage VBG2-2(T) output finally, and the band gap voltage VBG(T) and a band gap voltage VBG2-1(T) in the process of the adjustment. FIG. 9 is a graph which shows the band gap voltages VBG2-1(T) and VBG2-2(T) shown in FIG. 8 and in which a voltage axis is enlarged. In FIG. 9, to compare the band gap voltages VBG2-1(T) and VBG2-2(T) in one graph, the band gap voltage VBG2-1(T) is offset wholly. As with the voltage shown in FIG. 15, the band gap voltage VBG(T) shown in FIG. 8 is a voltage in which only the first-order temperature coefficient is adjusted.

Figure 15:
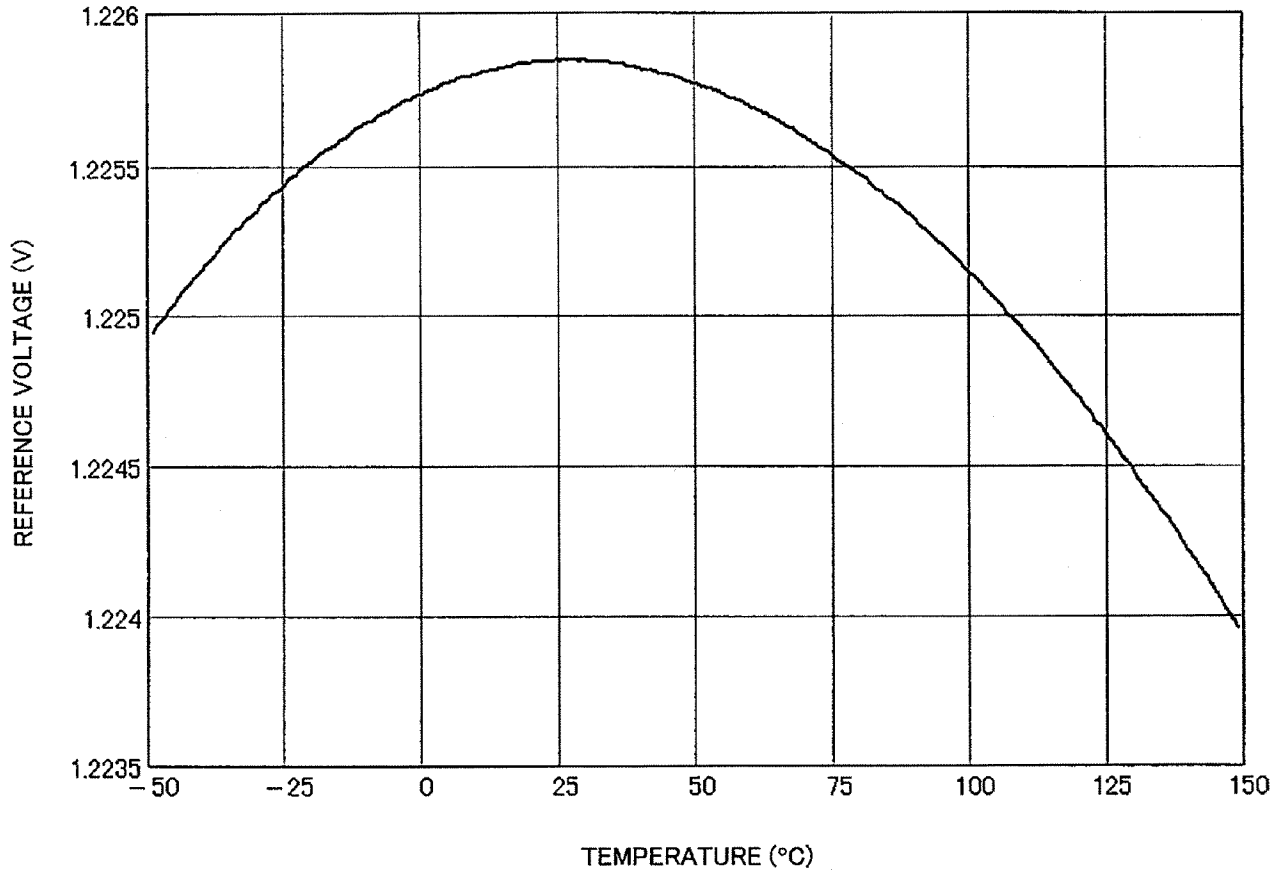
PRIOR ART Fig. 15
FIG. 15 is a graph showing a temperature dependence characteristic of the reference voltage generated by the conventional reference voltage generating circuit.

In a procedure of adjusting the reference voltage VBG2, first, the adjusting resistor R3 of the first adjusting circuit element 2 is adjusted such that the first-order temperature coefficient of the band gap voltage is canceled. Since the band gap voltage VBG(T) in which the first-order temperature coefficient has been adjusted includes the second-order temperature coefficient, it quadratically changes in accordance with the temperature change. Here, as described above, the input-output ratio (1:k) of the current mirror circuit element 5 is adjusted such that the second-order temperature coefficient of the band gap voltage VBG(T) is canceled. Here, the adjust current Icr includes a first-order differential component (when generating the adjust current Icr in the second adjusting circuit element 3, not only a second-order differential component but also the first-order differential component and a zero-order differential component are generated). Therefore, the band gap voltage VBG2-1(T) adjusted by the current mirror circuit element 5 changes substantially linearly in accordance with the temperature change (the band gap voltage VBG2-1(T) again includes the first-order temperature coefficient). Here, by adjusting the adjusting resistor R3 again, the first-order temperature coefficient included in the band gap voltage VBG2-1(T) is canceled. In a temperature range (−50 to 150° C.) commonly required by an electronic device to which the reference voltage generating circuit 1B is applied, as shown in FIG. 15, the band gap voltage VBG(T) in which only the first-order temperature coefficient has been adjusted changes by about 4 mV, whereas as shown in FIG. 9, the band gap voltage VBG2-1(T) in which the second-order differential component has been adjusted changes only by about 0.2 mV. Further, as shown in FIG. 9, the band gap voltage VBG2-2(T) in which the first-order temperature coefficient has been again adjusted changes only by about 0.1 mV or less. According to the above configuration, it is possible to generate the band gap voltage VBG2-2(T) which changes little in accordance with the temperature change. Therefore, by outputting the band gap voltage VBG2-2(T) as the reference voltage VBG2, it is possible to output the reference voltage VBG2 which is stable at any temperature.

Figure 10:
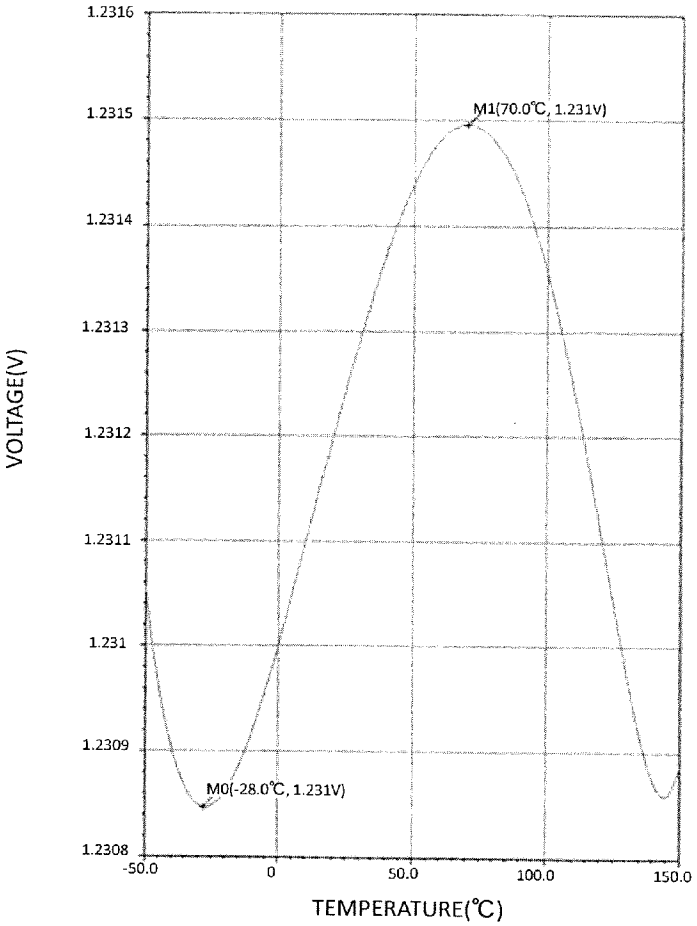
FIG. 10 is a graph showing the result of a simulation regarding the change in the reference voltage with respect to the temperature change, the reference voltage being output from the reference voltage generating circuit shown in FIG. 2.

FIG. 10 is a graph showing the result of a simulation regarding the change in the reference voltage with respect to the temperature change, the reference voltage being output from the reference voltage generating circuit shown in FIG. 2. As shown in FIG. 10, the result of the simulation done by using the circuit produced based on FIG. 2 has the same tendency as the band gap voltage VBG2-2 shown in FIGS. 8 and 9. That is, in the temperature range of −50 to 150° C., a change width of the reference voltage is only about 0.6 mV. The reason why the change width in FIG. 10 is slightly larger than that in each of FIGS. 8 and 9 may be because the band gap voltage is influenced by not only the temperature dependence characteristics of the bipolar transistors Q1 and Q2 but also leakage currents of the bipolar transistors Q1 and Q2 at high temperature and the performance of the differential amplifier 4. However, even in consideration of these influences, it is clear that the reference voltage generating circuit of the present embodiment generates the reference voltage which is more adequately stable at any temperature than the voltage in which only the first-order temperature coefficient has been corrected.

Modification Example of Embodiment 2

Figure 11:
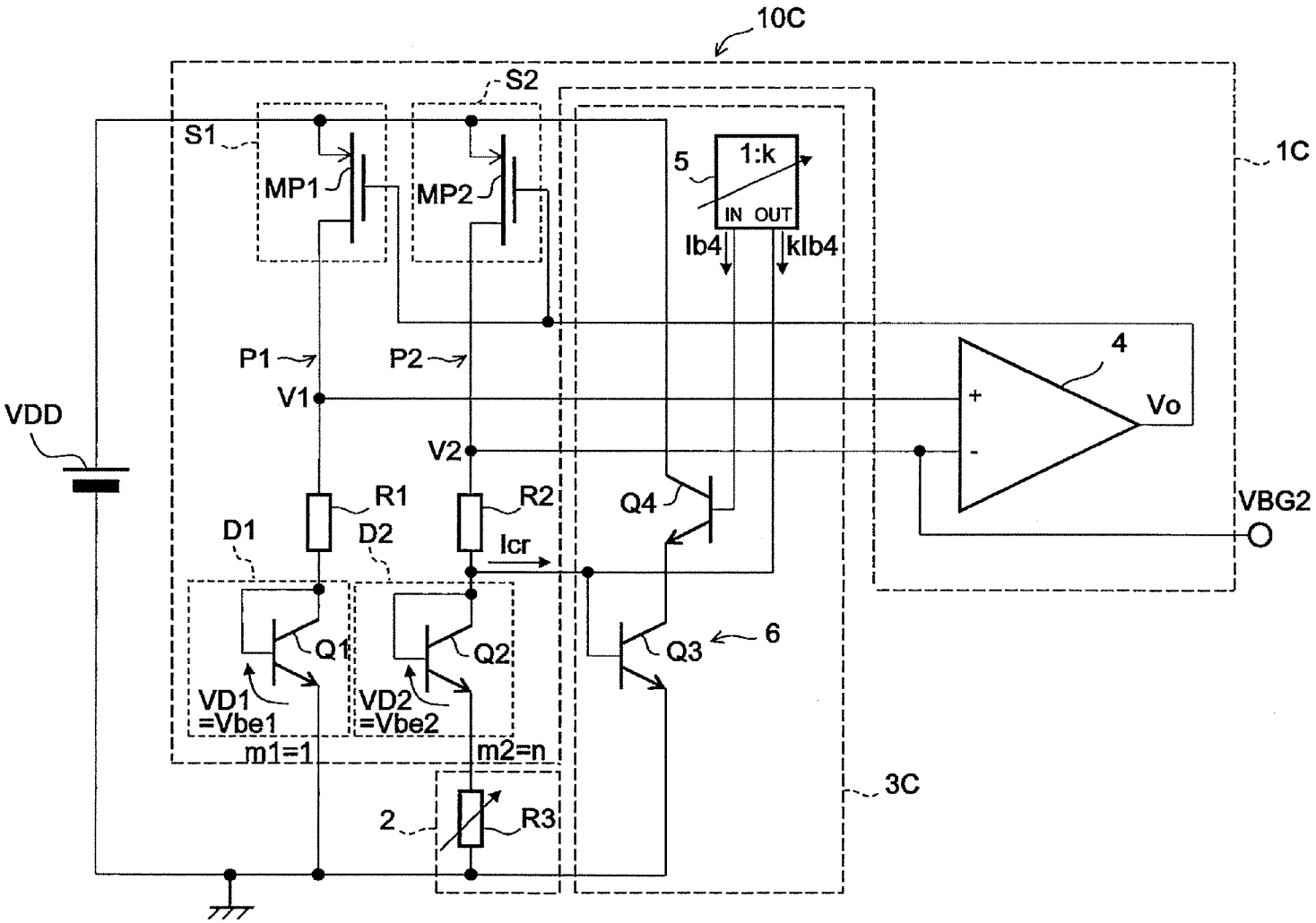
FIG. 11 is a circuit diagram showing a schematic configuration example of the reference voltage generating circuit according to Modification Example of Embodiment 2 of the present invention.

Next, Modification Example of the reference voltage generating circuit according to Embodiment 2 of the present invention will be explained. FIG. 11 is a circuit diagram showing a schematic configuration example of the reference voltage generating circuit according to Modification Example of Embodiment 2 of the present invention. In the present modification example, the same reference signs are used for the same components as in Embodiment 2, and a repetition of the same explanation is avoided. A reference voltage generating circuit 10C of the present modification example is different from the reference voltage generating circuit of Embodiment 2 in that a second adjusting circuit element 3C generates the adjust current Icr between the second resistor R2 and the second diode characteristic element D2. Specifically, in the second adjusting circuit element 3C, the output terminal of the current mirror circuit element 5 is connected to a portion between the second resistor R2 and the second diode characteristic element D2. Further, in the present modification example, a voltage between the first current source element S1 and the first resistor R1 is applied as the first voltage V1 to the noninverting input terminal of the differential amplifier 4, and a voltage between the second current source element S2 and the second resistor R2 is applied as the second voltage V2 to the inverting input terminal of the differential amplifier 4. The second voltage V2 is the reference voltage VBG2 output by the reference voltage generating circuit 10C.

The adjust current Icr generated by the second adjusting circuit element 3C may be supplied to any portion of the path of the reference voltage generating circuit element 1C. For example, as shown in Embodiments 1 and 2, the adjust current Icr generated by the second adjusting circuit element 3C may be supplied to a portion between the second path P2 and the inverting input terminal of the differential amplifier 4, a portion between the first path P1 and the noninverting input terminal of the differential amplifier 4, or a predetermined portion of the first path P1, or as shown in the present modification example, the adjust current Icr generated by the second adjusting circuit element 3C may be supplied to a predetermined portion of the second path P2 or a return path (a portion between the output terminal of the differential amplifier 4 and the first and second resistors R1 and R2) of the differential amplifier 4. As above, the adjust current Icr for canceling the second-order temperature coefficient of the reference voltage VBG2 can be selected freely in the path of the reference voltage generating circuit element 1. Thus, the degree of freedom of the circuit design can be increased.

Example of Application of Reference Voltage Generating Circuit

Figure 12:
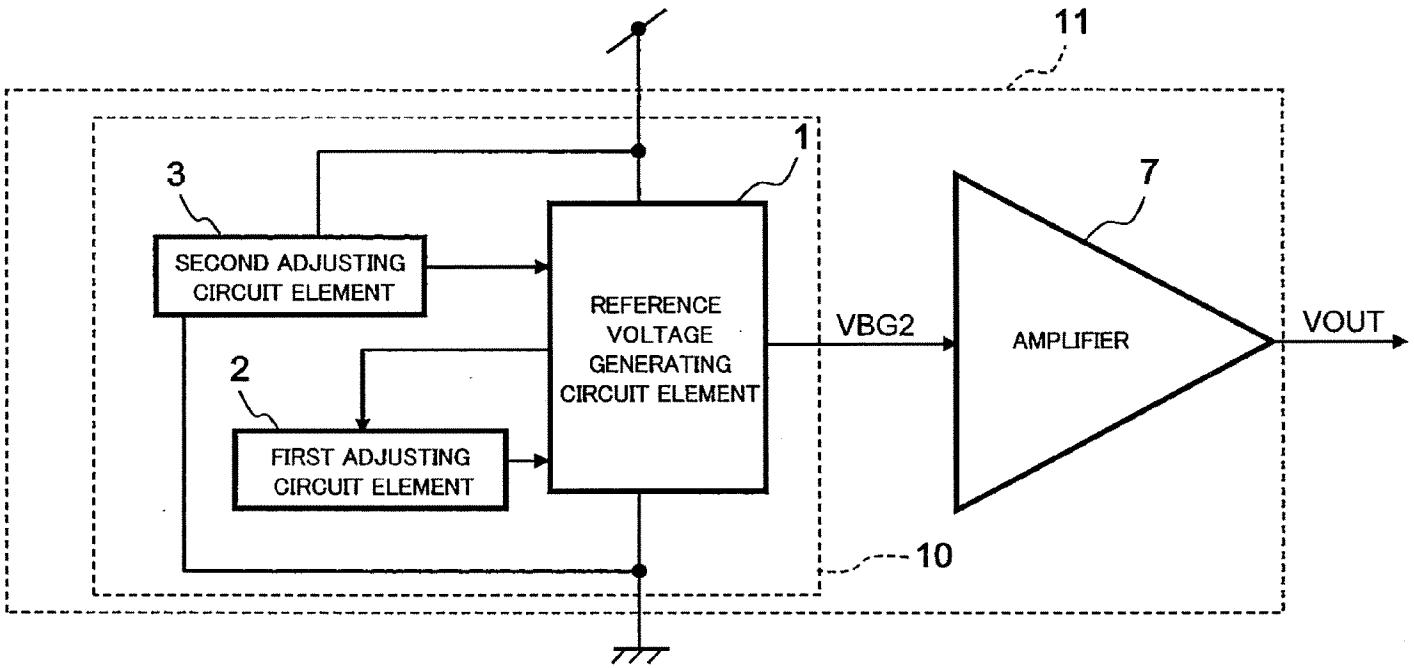
FIG. 12 is a circuit diagram showing a schematic configuration example of a reference voltage source to which the reference voltage generating circuit according to one embodiment of the present invention is applied.

A configuration example of the reference voltage source using the reference voltage generating circuit explained in the above embodiments will be explained. FIG. 12 is a circuit diagram showing a schematic configuration example of the reference voltage source to which the reference voltage generating circuit according to one embodiment of the present invention is applied. As shown in FIG. 12, a reference voltage source 11 of the present example of application includes the reference voltage generating circuit 10 shown in, for example, FIG. 1 and an amplifier 7 configured to amplify the reference voltage VBG2 output from the reference voltage generating circuit 10. The reference voltage source 11 configured as above outputs the reference voltage VBG2 in which the first-order temperature coefficient and the second-order temperature coefficient are respectively adjusted by the separate adjusting circuit elements 2 and 3. Therefore, the temperature dependence characteristic can be improved by a simple configuration.

Further, the adjustment of an amplification factor A0 by the amplifier 7 denotes an adjustment of the zero-order temperature coefficient of the reference voltage VBG2. An output voltage VOUT of the reference voltage source output from the amplifier 7 is represented by a formula "VOUT=A0·VBG2(T)". Therefore, by adjusting the amplification factor A0 of the amplifier 7, the desired output voltage VOUT can be obtained as a voltage which changes little in accordance with temperatures.

Figure 13:
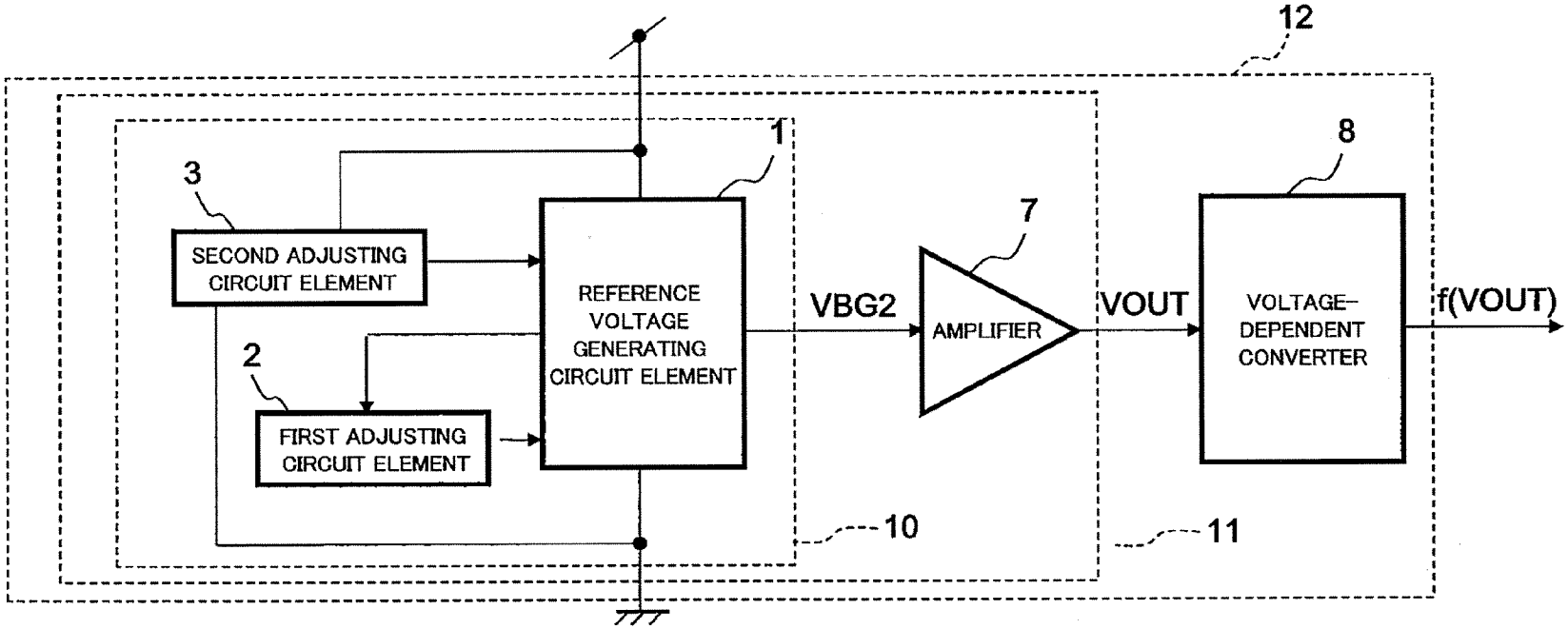
FIG. 13 is a circuit diagram showing a schematic configuration example of a device to which the reference voltage source according to one embodiment of the present invention is applied.
Figure 14:
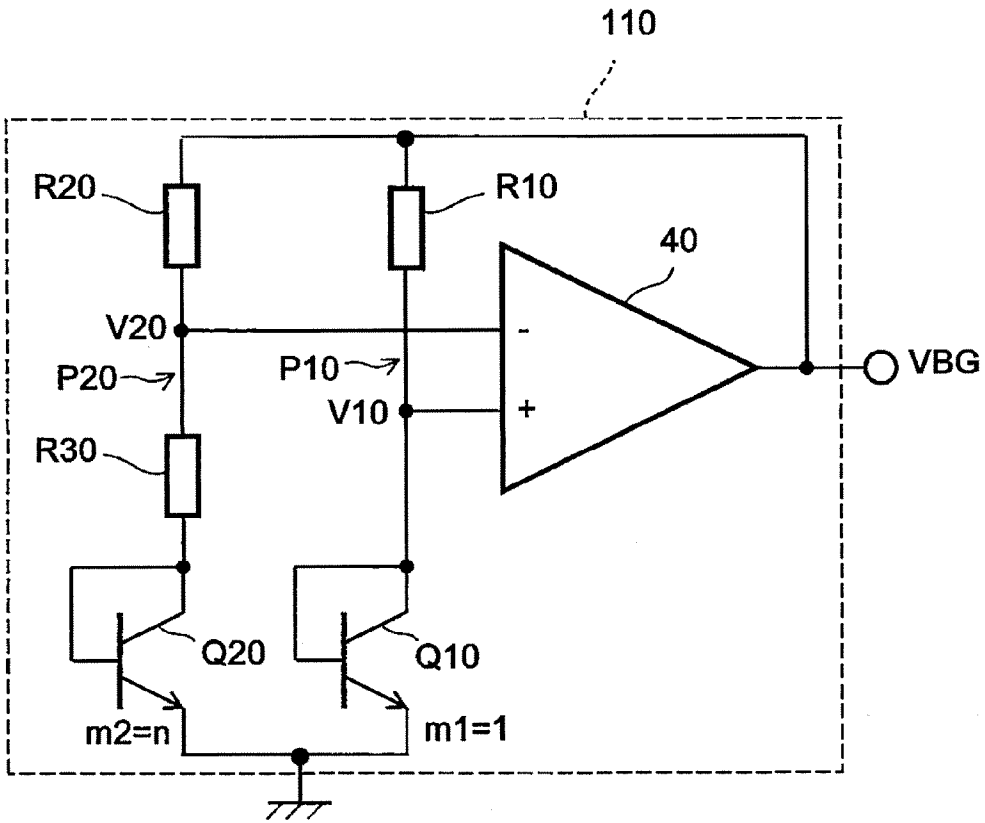
PRIOR ART Fig. 14
FIG. 14 is a circuit diagram showing a basic configuration of a conventional reference voltage generating circuit.

Further, a device to which the reference voltage source 11 described above is applied will be explained. FIG. 13 is a circuit diagram showing a schematic configuration example of a device 12 to which the reference voltage source according to one embodiment of the present invention is applied. As shown in FIG. 13, the device 12 includes the reference voltage source 11 shown in FIG. 12 and a voltage-dependent converter 8 configured to perform predetermined conversion by using the output voltage VOUT output from the reference voltage source 11. The voltage-dependent converter 8 is not especially limited as long as it is a device configured to use the output voltage VOUT generated based on the reference voltage VBG2. Examples of the voltage-dependent converter 8 include voltage converters, voltage-to-current converters, AD converters, DA converters, temperature detectors, battery controllers, frequency converters, and voltage-controlled oscillators (VCO).

Generally, the voltage-dependent converter 8 outputs a linear conversion output signal F to the output voltage VOUT (performs a linear operation). In a case where a temperature characteristic function of the voltage-dependent converter 8 is denoted by f(T), the conversion output signal F is represented by a formula "F(T)=f(T)+VOUT(T)". That is, by adjusting the zero-order to second-order temperature coefficients of the output voltage VOUT(T) of the reference voltage source 11, the zero-order to second-order temperature coefficients of the conversion output F(T) can be reduced.

In the case of considering the temperature characteristic represented by a second-order temperature characteristic function, the temperature characteristic function f(T) can be represented by a formula "$f(T)=f_0(1+a1\cdot\Delta T/T_0)\cdot(1+a2\cdot\Delta T/T_0)$", and the output voltage VOUT(T) is represented by a formula "$VOUT(T)=VOUT_0(1+b1\cdot\Delta T/T_0)\cdot(1+b2\cdot\Delta T/T_0)$". In these formulas, $f_0$ denotes a value of the temperature characteristic function f at the reference temperature $T_0$, $VOUT_0$ denotes a value of the output voltage VOUT at the reference temperature $T_0$, and a1, a2, b1, and b2 denote coefficients.

For example, in a case where the voltage-dependent converter 8 outputs an output signal F(T) proportional to a voltage, the output signal F(T) is represented by a formula "$F(T)=f(T)\cdot VOUT(T)=f_0(1+a1\cdot\Delta T/T_0)\cdot(1+a2\cdot\Delta T/T_0)\cdot VOUT_0(1+b1\cdot\Delta T/T_0)\cdot(1+b2\cdot\Delta T/T_0)$". Here, if each of the coefficients a1, a2, b1, and b2 is smaller than one, the above formula can be approximated as below. That is, the output signal F(T) is represented by a formula "$F(T)=f_0\cdot VOUT_0\cdot(1+(a1+b1)\cdot\Delta T/T_0+a1\cdot b1\cdot(\Delta T/T_0)^2)\cdot(1+(a2+b2)\cdot\Delta T/T_0+a2\cdot b2\cdot(\Delta T/T_0)^2)$". Therefore, by adjusting the temperature coefficient of the reference voltage generating circuit 10 such that a formula "a1+b1=a2+b2=0" becomes true, the first-order temperature coefficient (a1+b1)·(a2+b2) of the output signal F(T) of the voltage-dependent converter 8 can be canceled, and the second-order temperature coefficient (a1·b1+a2·b2) of the output signal F(T) can be reduced.

Even in a case where the voltage-dependent converter 8 outputs the output signal F(T) inversely proportional to a voltage, the temperature coefficients can be reduced as with the above by using an approximation of a formula "$1/(1+x)\approx 1-x(|x|<<1)$".

The foregoing has explained the embodiments of the present invention. However, the present invention is not limited to the above embodiments, and various improvements, changes, and modifications may be made within the spirit of the present invention. For example, respective components in the above plurality of embodiments and the modification example may be arbitrarily combined with one another. Although the specific configurations of the first and second diode characteristic elements D1 and D2, the second adjusting circuit element 3, the differential amplifier 4, and the like are explained in Embodiment 2, the same configurations are applicable to Embodiment 1. In addition, the specific configurations of the first and second diode characteristic elements D1 and D2, the second adjusting circuit element 3, the differential amplifier 4, and the like are not limited to the above configurations as long as the operations explained in the above embodiments can be performed.

INDUSTRIAL APPLICABILITY

The reference voltage generating circuit of the present invention is useful to improve the temperature dependence characteristic by a simple configuration.

From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the spirit of the present invention.

What is claimed is:

1. A reference voltage generating circuit comprising:

a reference voltage generating circuit element including a first diode characteristic element and a second diode characteristic element, a density of a current flowing through the second diode characteristic element being different from a density of a current flowing through the first diode characteristic element, the reference voltage generating circuit element being configured to output a reference voltage generated based on a difference between voltages respectively applied to the first diode characteristic element and the second diode characteristic element;

a first adjusting circuit element configured to adjust a first-order temperature coefficient of the reference voltage; and a second adjusting circuit element configured to adjust a second-order temperature coefficient of the reference voltage, wherein:

the second adjusting circuit element includes a current source configured to generate a current adjusted such that a second-order differential component of the reference voltage is canceled, the current source includes a first circuit element having such a diode characteristic that the current generated by the current source cancels the second-order differential component of the reference voltage, the first circuit element of the current source includes a bipolar transistor, the current source further includes a second circuit element and a current mirror circuit element, the second circuit element being configured to cause a current to flow between a collector and emitter of the first circuit element based on a current flowing through one of the first and second diode characteristic elements of the reference voltage generating circuit element, the current mirror circuit element being configured to receive a current flowing through a base of the first circuit element and output a correction current to a path of the reference voltage generating circuit element, and the current mirror circuit element is configured such that a current input to the reference voltage generating circuit element is adjusted by adjusting an input-output ratio of the current mirror circuit element.

2. A reference voltage generating circuit comprising:

a reference voltage generating circuit element including a first diode characteristic element and a second diode characteristic element, a density of a current flowing through the second diode characteristic element being different from a density of a current flowing through the first diode characteristic element, the reference voltage generating circuit element being configured to output a reference voltage generated based on a difference between voltages respectively applied to the first diode characteristic element and the second diode characteristic element;

a first adjusting circuit element configured to adjust a first-order temperature coefficient of the reference voltage; and a second adjusting circuit element configured to adjust a second-order temperature coefficient of the reference voltage, wherein:

the second adjusting circuit element includes a current source configured to generate a current adjusted such that a second-order differential component of the reference voltage is canceled, and the current source is configured to generate a current which is represented by $C \cdot \exp(-t)$, where t is temperature and C denotes a constant.

3. The reference voltage generating circuit according to claim 1, wherein the current source includes a first circuit element having such a diode characteristic that the current generated by the current source cancels the second-order differential component of the reference voltage.

4. The reference voltage generating circuit according to claim 1, wherein:

the reference voltage generating circuit element includes:

a first path including the first diode characteristic element and a first resistor connected in series to the first diode characteristic element;

a second path including the second diode characteristic element and a second resistor connected in series to the second diode characteristic element; and a differential amplifier configured to receive a first voltage at a predetermined portion of the first path and a second voltage at a portion of the second path corresponding to the first voltage, and is configured to output as the reference voltage a voltage applied to at least one of the first resistor and the second resistor, and the first adjusting circuit element includes an adjusting resistor connected to one of the first diode characteristic element and the second diode characteristic element.

5. A reference voltage source comprising:

the reference voltage generating circuit according to claim 1; and an amplifier configured to amplify the reference voltage.

* * * * *